US009140104B2

(12) United States Patent
Zung

(10) Patent No.: US 9,140,104 B2
(45) **Date of Patent: *Sep. 22, 2015**

(54) SPLIT EMERGENCY CONTAINMENT DOME

(71) Applicant: Thomas T. K. Zung, Bratenahl, OH (US)

(72) Inventor: Thomas T. K. Zung, Bratenahl, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/329,819

(22) Filed: Jul. 11, 2014

(65) Prior Publication Data

US 2015/0016890 A1 Jan. 15, 2015

Related U.S. Application Data

(60) Provisional application No. 61/845,661, filed on Jul. 12, 2013.

(51) Int. Cl.

| | |
|---|---|
| ***E21B 43/00*** | (2006.01) |
| ***E21B 43/01*** | (2006.01) |
| ***E21B 43/34*** | (2006.01) |
| ***E21B 43/36*** | (2006.01) |
| *E02B 15/00* | (2006.01) |

(52) U.S. Cl.

CPC ..... *E21B 43/0122* (2013.01); *E02B 2015/005* (2013.01)

(58) Field of Classification Search

CPC ..... E21B 43/0122; E21B 43/00; E21B 43/01; E21B 43/34; E21B 43/36; E02B 2015/005; E02B 15/0814; E02B 15/08; E02B 17/02; E02B 15/046; E02B 15/042

USPC ..... 405/52, 60, 63, 64, 203, 205, 210; 210/170.11, 242.3, 923, DIG. 5

See application file for complete search history.

(56) References Cited

U.S. PATENT DOCUMENTS

| | | | | | |
|---|---|---|---|---|---|
| 1,830,061 | A | * | 11/1931 | Howe | 166/79.1 |
| 2,924,350 | A | * | 2/1960 | Greer | 220/567.2 |
| 3,203,144 | A | * | 8/1965 | Fuller | 52/81.4 |
| 3,245,178 | A | * | 4/1966 | Clark | 52/65 |
| 3,339,512 | A | * | 9/1967 | Siegel | 114/257 |
| 3,548,605 | A | * | 12/1970 | Armistead et al. | 405/60 |
| 3,610,194 | A | * | 10/1971 | Siegel | 114/257 |
| 3,658,181 | A | * | 4/1972 | Blair | 210/170.05 |
| 3,664,136 | A | * | 5/1972 | Laval et al. | 405/60 |
| 3,681,923 | A | * | 8/1972 | Hyde | 405/60 |
| 3,710,582 | A | * | 1/1973 | Hills et al. | 405/210 |
| 3,745,773 | A | * | 7/1973 | Cunningham | 405/60 |
| 3,824,942 | A | * | 7/1974 | Stafford et al. | 405/210 |

(Continued)

OTHER PUBLICATIONS

International Search Report and Written Opinion (PCT/US2014) dated Nov. 6, 2014—8 pages.

*Primary Examiner* — Benjamin Fiorello
*Assistant Examiner* — Edwin Toledo-Duran
(74) *Attorney, Agent, or Firm* — Dicke, Billig & Czaja, PLLC

(57) ABSTRACT

A split emergency containment dome for use in conjunction with an oil or gas well. The split emergency containment dome includes an upper containment portion and a closure mechanism. The upper containment portion has an enclosure defined therein that is adapted to receive equipment used in conjunction with the well and to retain therein oil or gas that escapes from the well. The upper containment portion includes a wall having an opening formed therein. The opening extends from a lower end to an upper end of the upper containment portion. The closure mechanism is capable of selectively closing at least a portion of the opening.

10 Claims, 5 Drawing Sheets

(56) References Cited

U.S. PATENT DOCUMENTS

| | | | | | |
|---|---|---|---|---|---|
| 3,879,951 | A | * | 4/1975 | Mason | 405/60 |
| 3,981,154 | A | * | 9/1976 | Hix, Jr. | 405/60 |
| 4,141,377 | A | * | 2/1979 | Fernandez et al. | 137/236.1 |
| 4,146,482 | A | * | 3/1979 | Shyu | 210/242.3 |
| 4,229,297 | A | * | 10/1980 | Nohmi et al. | 210/654 |
| 4,231,873 | A | * | 11/1980 | Swigger | 210/170.05 |
| 4,283,159 | A | * | 8/1981 | Johnson et al. | 405/60 |
| 4,298,295 | A | * | 11/1981 | Bozzo et al. | 405/52 |
| 4,318,442 | A | * | 3/1982 | Lunde et al. | 166/357 |
| 4,358,218 | A | * | 11/1982 | Graham | 405/60 |
| 4,358,219 | A | * | 11/1982 | Burns | 405/60 |
| 4,373,834 | A | * | 2/1983 | Grace | 405/60 |
| 4,382,716 | A | * | 5/1983 | Miller | 405/60 |
| 4,402,632 | A | * | 9/1983 | Cook | 405/210 |
| 4,449,850 | A | * | 5/1984 | Cessou et al. | 405/60 |
| 4,456,071 | A | * | 6/1984 | Milgram | 166/356 |
| 4,531,860 | A | * | 7/1985 | Barnett | 405/60 |
| 5,050,680 | A | * | 9/1991 | Diehl et al. | 166/356 |
| 5,195,842 | A | * | 3/1993 | Sakow | 405/60 |
| 6,592,299 | B1 | * | 7/2003 | Becker | 405/210 |
| 8,025,103 | B1 | * | 9/2011 | Wolinsky | 166/364 |
| 8,158,010 | B2 | * | 4/2012 | Pearse et al. | 210/747.1 |
| 8,523,482 | B1 | * | 9/2013 | Watson, Sr. | 405/60 |
| 2005/0025574 | A1 | * | 2/2005 | Lazes | 405/60 |
| 2006/0144455 | A1 | * | 7/2006 | Meyers et al. | 138/30 |
| 2010/0143038 | A1 | * | 6/2010 | Cobb | 405/63 |
| 2011/0318107 | A1 | * | 12/2011 | Dighe | 405/63 |
| 2012/0305493 | A1 | * | 12/2012 | Zung | 210/747.6 |
| 2013/0108369 | A1 | * | 5/2013 | Splittstoesser | 405/63 |

* cited by examiner

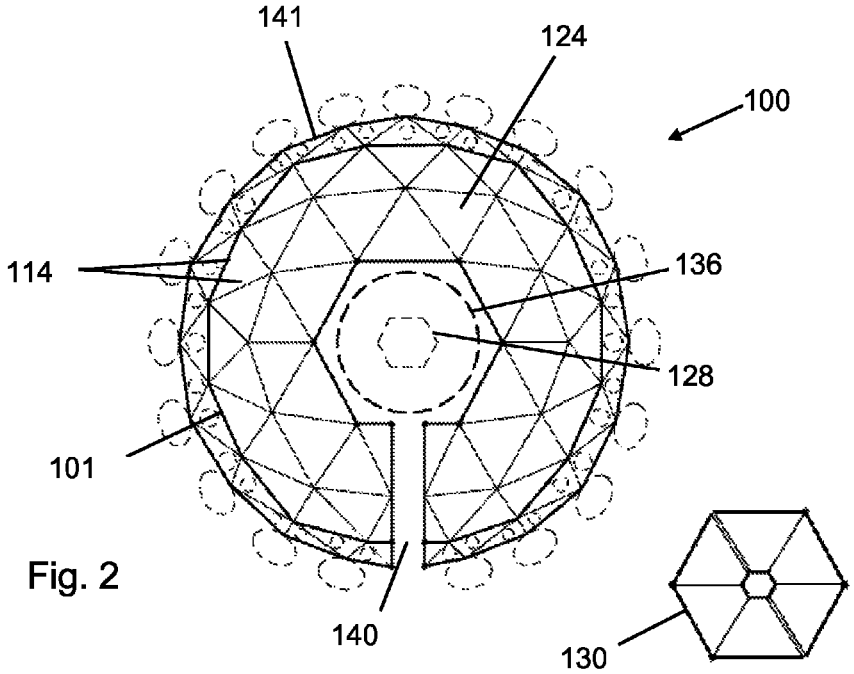
Fig. 2
Fig. 3
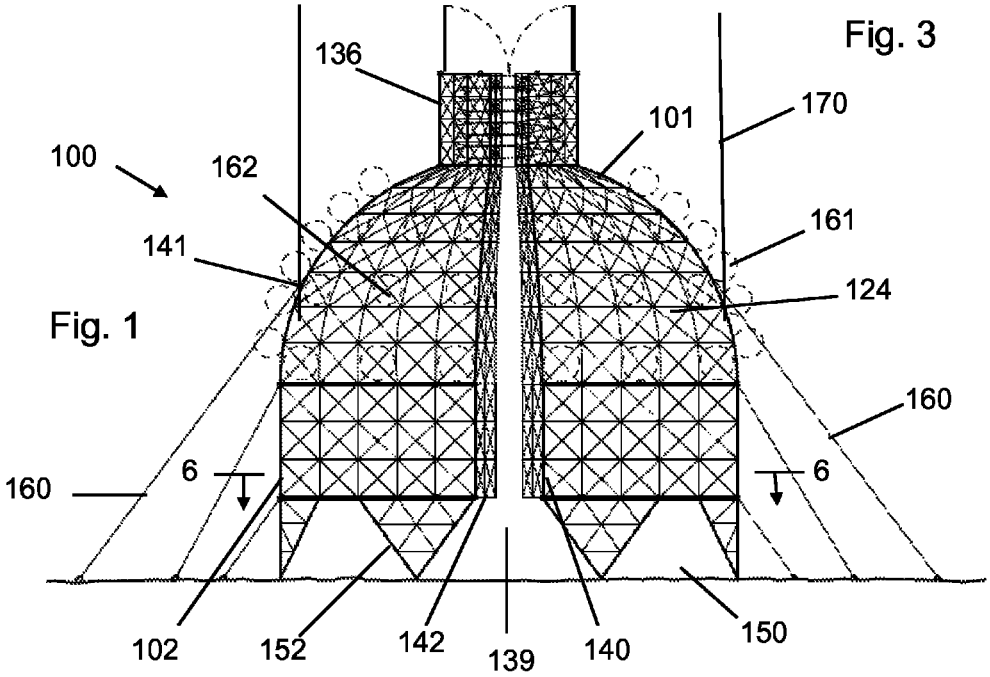
Fig. 1

Fig. 8
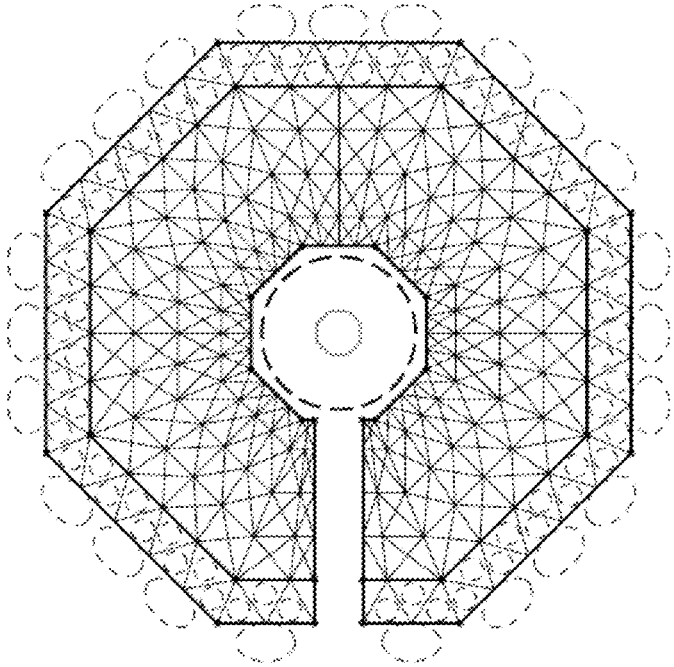
200
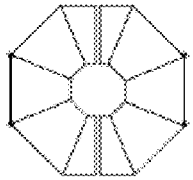
Fig. 9
Fig. 7
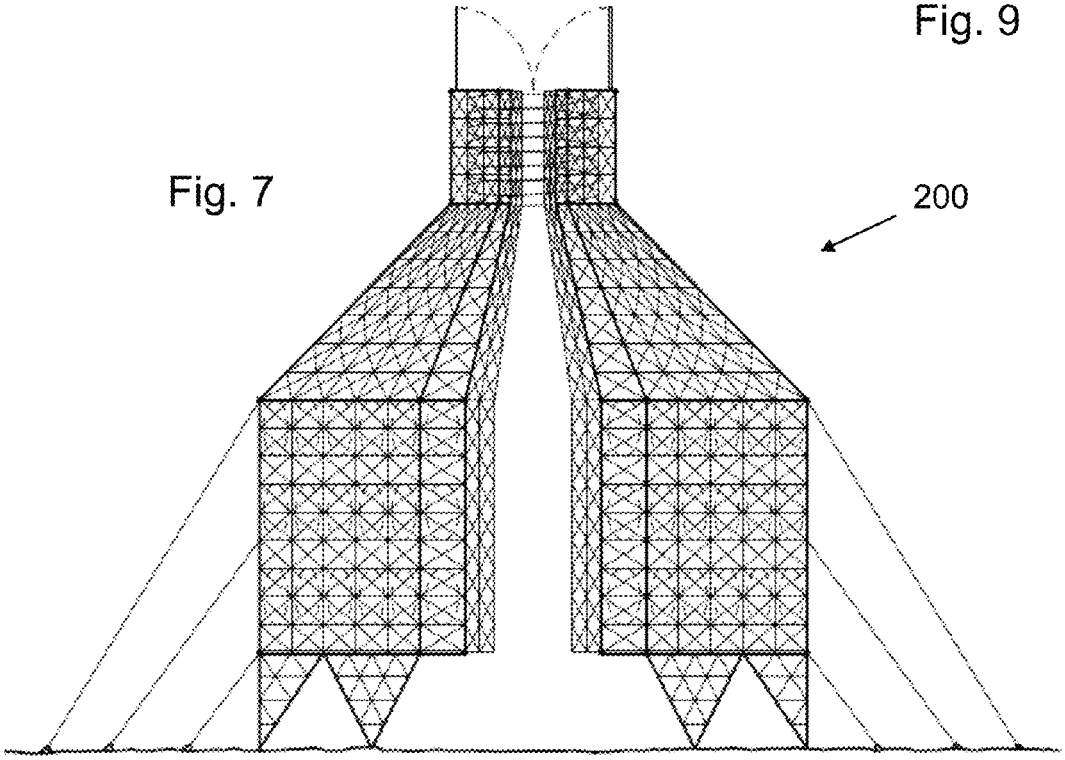
200

SPLIT EMERGENCY CONTAINMENT DOME

REFERENCE TO RELATED APPLICATION

This application claims priority to U.S. Application No. 61/845,661, which was filed on Jul. 12, 2013, the contents of which are hereby incorporated by reference.

FIELD OF THE INVENTION

The invention relates generally to an oil recovery system. More particularly, the invention relates to a split emergency containment dome.

BACKGROUND OF THE INVENTION

Crude oil is a popular source of energy for vehicles such as cars, trucks and motorcycles. There are various other uses for crude oil and products refined therefrom.

Typically, the crude oil is obtained from a well that is drilled beneath a surface of the ground. In addition to the wells being drilled into the ground on one of the continents, it has also been recognized that wells can be drilled into the ground located beneath bodies of water.

It is generally desired to collect substantially all of the crude oil that is extracted from a well to maximize the income generated from the well as well as to minimize the negative effects that are experienced when the oil escapes into the region surrounding the well.

While oil drilling technology enables drilling wells into very deep bodies of water such as having a depth of greater than about 5,000 feet, it becomes increasingly difficult to address issues that may develop at these depths. For example, it is generally not possible for humans to be utilized to directly perform tasks at these depths. Rather, the immense pressures at these depths necessitate that the work be done using robotically controlled devices.

Even in situations where safety devices such as blowout preventers are utilized to address problems that may arise when drilling wells at these depths, it is possible that the safety devices may malfunction and that the crude oil may escape from the well and become intermixed with the body of water in which the well is located.

The presence of the crude oil in the water can be a health hazard to organisms that live in the body of water not only causing death to the organisms but also precluding the use of the organisms as a food source. The crude oil can also contaminate the shore that surrounds the body of water and thereby preclude the use of the shore for recreational activities.

In view of the hazards associated with crude oil escaping into a body of water, it is desirable to utilize a system that provides the ability to contain the crude oil that escapes during the drilling process such that the escaped crude oil may be recovered.

Most past efforts and equipment designed for these purposes were based upon the principal that you needed a large heavy mass (100 ton concrete dome with opening at the top) to capture the oil and withstand the pressure at more than 5,000 feet below sea level. It has also been attempted to utilize methods that work above sea level. However, such methods do not consistently work below sea level at the pressures experienced at those levels.

SUMMARY OF THE INVENTION

An embodiment of the invention is directed to a split emergency containment dome for use in conjunction with an oil or gas well. The split emergency containment dome includes an upper containment portion and a closure mechanism.

The upper containment portion has an enclosure defined therein that is adapted to receive equipment used in conjunction with the well and to retain therein oil or gas that escapes from the well. The upper containment portion includes a wall having an opening formed therein. The opening extends from a lower end to an upper end of the upper containment portion. The closure mechanism is capable of selectively closing at least a portion of the opening.

Another embodiment of the invention is directed to a method of containing and recovering oil or gas that leaks from a well that is located beneath a surface of a body of water. At least one conduit extends from the well. A split emergency containment dome is constructed that includes an upper containment portion having enclosure defined therein that is adapted to receive equipment used in conjunction with a well and to retain therein oil or gas that escapes from the well. The upper containment portion includes a wall having an opening formed therein. The opening extends from a lower end to an upper end of the upper containment portion.

The split emergency containment dome is moved into a position that is over the well. As the split emergency containment dome is moved into the position over the well, the at least one conduit passes through the opening. The opening is at least partially closed with a closure mechanism that is operably attached to the split emergency containment dome.

Another embodiment of the invention is directed to an oil containment and recovery system that includes an oil containment dome and a flexible enclosure. The oil containment dome includes an upper containment portion that is adapted to receive equipment used in conjunction with a well and to retain therein oil or gas that escapes from the well. The flexible enclosure is operably attached to the oil containment dome. The flexible enclosure is movable with respect to the oil containment dome in response to oil or gas collecting therein.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

FIG. 1 is an elevation view of a split emergency containment dome according to an embodiment of the invention.

FIG. 2 is a plan view of the 144 split emergency containment dome of FIG. 1.

FIG. 3 is a top view of cover panels for use with the split emergency containment dome of FIG. 1.

FIG. 7 is an elevation view of a split emergency containment dome according to another embodiment of the invention.

FIG. 8 is a plan view of the split emergency containment dome of FIG. 7.

FIG. 9 is a top view of cover panels for use with the split emergency containment dome of FIG. 7.

DETAILED DESCRIPTION OF THE INVENTION

Figure 4:
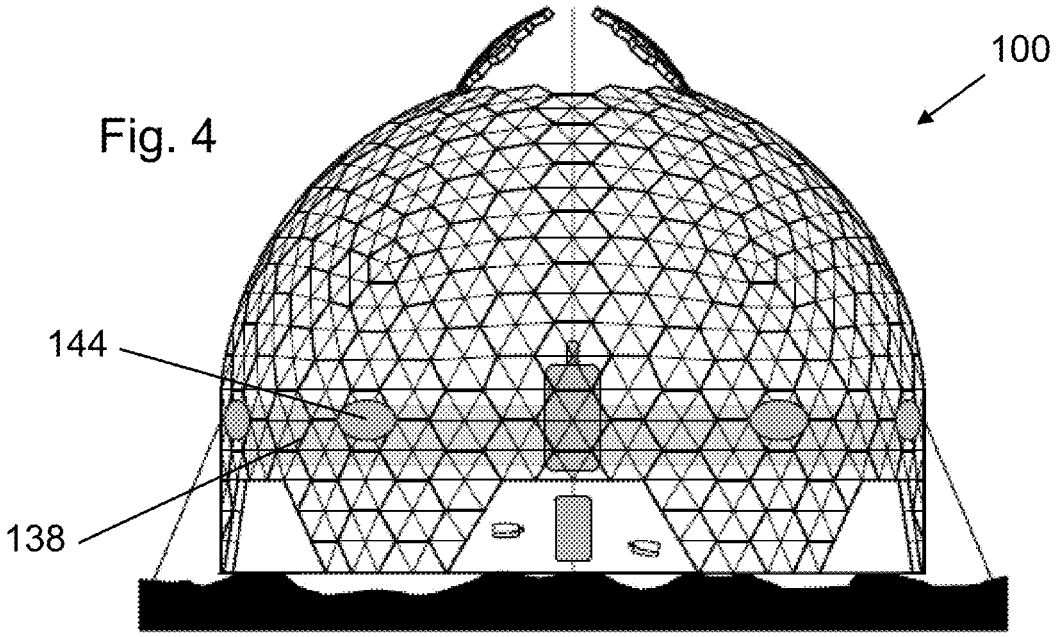
FIG. 4 is an elevation section view of the split emergency containment dome with an inner liner in an initial configuration.

An embodiment of the invention is directed to a split emergency containment dome as illustrated at 100 in the figures. The split emergency containment dome 100 is particularly suited for use in conjunction with an oil or gas well that was previously drilled in the seabed below a body of water. In particular, the split emergency containment dome 100 is suited for placement over an oil or gas well from which oil and/or gas is leaking.

In certain embodiments, the split emergency containment dome 100 is used in conjunction with deep-water oil wells such as those wells drilled in water having depths of more than about 500 feet. In other embodiments, the oil wells are drilled in water at a depth of more than 5,000 feet.

In still other embodiments, it is possible to use the split emergency containment dome 100 in conjunction with wells that are in relatively shallow water where it is especially desirable to minimize the potential of oil and/or gas escaping from the well into the water.

The split emergency containment dome 100 is positioned on the seabed beneath the body of water such that any oil or gas that escapes from the oil well is substantially contained within the split emergency containment dome 100. Containing the oil within the split emergency containment dome 100 facilitates recovering the oil and/or gas to minimize the potential of negative environmental impact from the oil and/or gas.

Oil and/or gas that are contained within the split emergency containment dome 100 may be directed to tankers that are positioned on the water surface proximate the split emergency containment dome 100 such as using at least one conduit or feeder line.

The split emergency containment dome 100 should be formed with sufficient strength to withstand damage and/or movement. The split emergency containment dome 100 may also have sufficient strength to withstand pressure developed within the split emergency containment dome 100 caused by accumulation of oil and/or gas there within. In certain embodiments, at least a portion of the split emergency containment dome 100 has a geodesic shape, as illustrated in FIGS. 1 and 2.

The split emergency containment dome 100 may be formed with a size that is sufficiently large to encompass not only the oil drilling equipment positioned on the seabed beneath the body of water but also to encompass a large percentage of oil and/or gas that could potentially leak from the oil well before such leaked oil and/or gas could be recovered.

In certain embodiments, the split emergency containment dome 100 has a diameter of between about 50 feet and about 300 feet. In other embodiments, the split emergency containment dome 100 has a diameter of about 500 feet.

If the split emergency containment dome 100 is fabricated with a diameter of about 200 feet, the split emergency containment dome 100 would be able to hold more than about 700,000 barrels of oil that leaked from the oil well.

The split emergency containment dome 100 may generally include an upper spherical section 101 and a lower cylinder section 102. The upper spherical section 101 may have a generally geodesic shape, as illustrated in FIGS. 1 and 2. The upper spherical section 101 and lower cylinder section 102 may be formed from a plurality of structural beams 114 that are attached together.

Figure 6:
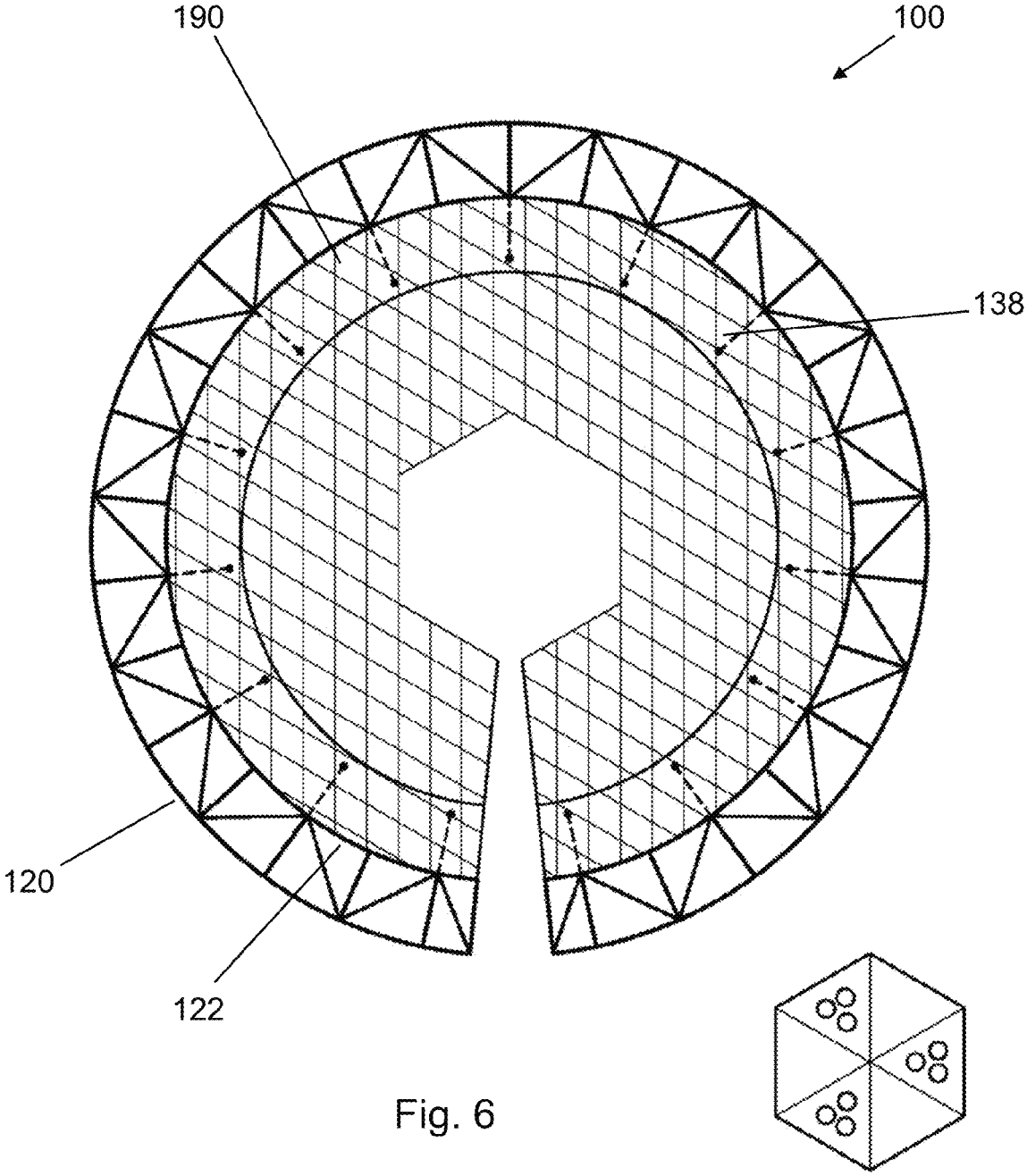
FIG. 6 is a plan view of the split emergency containment dome of FIG. 1 taken along a line 6-6 in FIG. 1.

In certain embodiments, the split emergency containment dome 100 may include an outer dome section 120 and an inner dome section 122, as illustrated in FIGS. 1 and 2. The outer dome section 120 has a diameter that is larger than a diameter of the inner dome section 122. This dome configuration has been referred to as a double resonated dome—a space frame as illustrated in FIG. 6.

An advantage of using this configuration is that a force placed on the outer dome section 120 is distributed to the inner dome section 122. This process increases the strength of the split emergency containment dome 100 to thereby minimize the potential that the force results in deformation and/or damage to the split emergency containment dome 100.

It is possible for the outer dome section 120 and the inner dome section 122 to both have the same configuration. In certain embodiments, the outer dome section 120 may be fabricated with a generally triangular configuration. In other embodiments, the outer dome section may be fabricated with a generally hexagonal/polygonal configuration.

The outer dome section 120 and the inner dome section 122 may be interconnected by a plurality of connecting members. Interconnecting the inner dome section 122 and the outer dome section 120 enhances the strength of the split emergency containment dome 100.

In one such configuration, the inner dome section 122 has structural elements that are arranged in a hexagonal configuration and the outer dome section 120 has structural elements that are arranged in a triangular configuration.

The outer dome section 120 may include two types of structural elements. The first structural elements may be arranged in a hexagonal configuration. The second structural elements may be arranged to define six triangles within each of the hexagons defined by the first structural elements.

The first structural elements may have a diameter that is different than a diameter of the second structural elements. For example the diameter of the first structural elements may be greater than the diameter of the second structural elements.

In certain embodiments, the structural beams may have a length of between about 2 feet and about 12 feet. In other embodiments, the structural beams may have a length of between about 3 feet and about 8 feet.

The outer dome section 120 and the inner dome section 122 may be fabricated from a variety of materials using the concepts of the invention. The outer dome section 120 and the inner dome section 122 should resist degradation when exposed to the conditions under which the split emergency containment dome 100 is intended to be used. For example, the materials used to fabricate the outer dome section 120 and the inner dome section 122 should resist degradation when exposed to saline water.

For example, if the split emergency containment dome 100 is intended to be used in an ocean, the outer dome section 120 and the inner dome section 122 should resist degradation caused by salt and organisms that are conventionally present in ocean water.

In certain embodiments, the outer dome section 120 and the inner dome section 122 may be fabricated from a metallic or polymeric material. It may be desirable to fabricate the outer dome section 120 and the inner dome section 122 from materials that have a relatively high strength as well as being relatively lightweight.

Forming the outer dome section 120 and the inner dome section 122 from materials having these characteristics enhances the ability to move the split emergency containment dome 100 even if the split emergency containment dome 100 has a relatively large diameter and/or height.

Examples of such suitable materials include steel containing additives that reduce the degradation of the steel when the steel is exposed to the salt and organisms conventionally found in ocean water. In certain embodiments, the outer dome section 120 and the inner dome section 122 are fabricated from stainless steel, titanium, magnesium and fiberglass or fiber composites.

In certain embodiments, the structural beams may have a generally square, round, I-beam, H-beam, or rectangular profile with a height and a width that are both between about 1 inch and about 24 inches. In other embodiments, the height and the width of the structural beams are both between about 2 inches and about 24 inches.

A variety of techniques may be used for attaching the structural beams together. Examples of two such connection techniques are bolts and welding.

The split emergency containment dome 100 includes a wall 141 extending around an outer surface thereof and such wall 141 may have a side opening 140 formed therein that extends from an upper edge to a lower edge thereof. The side opening 140 enables the split emergency containment dome 100 to be moved into position over a leaking oil well without the need to disconnect equipment that is being used to drill the oil well and/or to remove oil and/or gas from the oil well.

The width of the side opening 140 needs to be greater than the width of the equipment that is being used to drill the oil well and/or to remove oil and/or gas from the oil well. In certain embodiments, the width of the side opening 140 is between about 2 feet and about 20 feet.

To minimize the potential of oil leaking from the interior of the split emergency containment dome 100 through the side opening 140, a closure mechanism 142 may be provided proximate at least one edge of the side opening 140. This closure mechanism 142 may be moveably and/or removably attached to the other portions of the split emergency containment dome 100.

In certain embodiments, the closure mechanism 142 may have an accordion-type configuration. The closure mechanism 142 may be biased to the closed configuration. During the process of positioning the split emergency containment dome 100 with respect to the leaking oil well, the closure mechanism 142 may be retained in the open configuration. Once the split emergency containment dome 100 is in the desired position, the restraint may be released, which causes the closure mechanism 142 to move to the closed configuration.

The closure mechanism 142 may include a locking mechanism (not shown) that retains the closure mechanism 142 in the closed configuration. The locking mechanism may be magnetically or mechanically operable. An example of one such closure mechanism 142 is at least one magnet. If the magnet is a permanent magnet, the closure mechanism is retained in the closed configuration without the need for a power source. Another suitable locking mechanism that may be used is a knife latch.

Similar to the other portions of the outer dome section 120 and/or the inner dome section 122, a barrier may be provided on at least one of an inner surface and an outer surface of the closure mechanism 142 to thereby restrict the ability of oil and/or gas from passing through the closure mechanism 142.

The split emergency containment dome 100 may have a top opening 128 proximate an upper end thereof that is adapted to receive pipes and/or other oil well drilling equipment that are used in drilling the oil well and/or removing oil and/or gas from the oil well. The size of the top opening 128 thereby depends on the size of the pipes and/or other oil well drilling equipment that are intended to extend there through.

Such a configuration enables relatively large size objects to be placed within the split emergency containment dome 100. An example of one such relatively large size object is a super blowout preventer. In certain embodiments, the top opening 128 may have a diameter of up to about 60 feet.

To minimize the potential for leaked oil and/or gas that is in the interior of the split emergency containment dome 100 from escaping through the top opening 128, the split emergency containment dome 100 may include a cap section 130 that covers at least a portion of the top opening 128. Such a cap section 130 is referred to as a Bucky Cap in honor of Buckminster Fuller, the creator of the geodesic dome, the patent applicant is a partner of Buckminster Fuller.

The cap section 130 may be separable from the other portions of the split emergency containment dome 100. The cap section 130 may formed in more than one piece, as illustrated in FIG. 3. Using such a configuration enables the cap section 130 to be readily moved between an open configuration and a closed configuration.

The cap section 130 may be fabricated similar to the other aspects of the outer dome section 120. In particular, the cap section 130 may be fabricated from a plurality of structural beam that are each attached together.

The cap section 130 may be operably attached to the other portions of the split emergency containment dome 100. In certain embodiments, the cap section 130 is pivotally attached to the other portions of the split emergency containment dome 100.

Depending on the area in which it is intended to use the split emergency containment dome 100, it is possible to fabricate the split emergency containment dome 100 with an extendable sleeve 136 that extends from an upper surface thereof. During the process of installing the split emergency containment dome 100 with respect to the oil well, the extendable sleeve 136 may be positioned in a retracted configuration.

Figure 5:
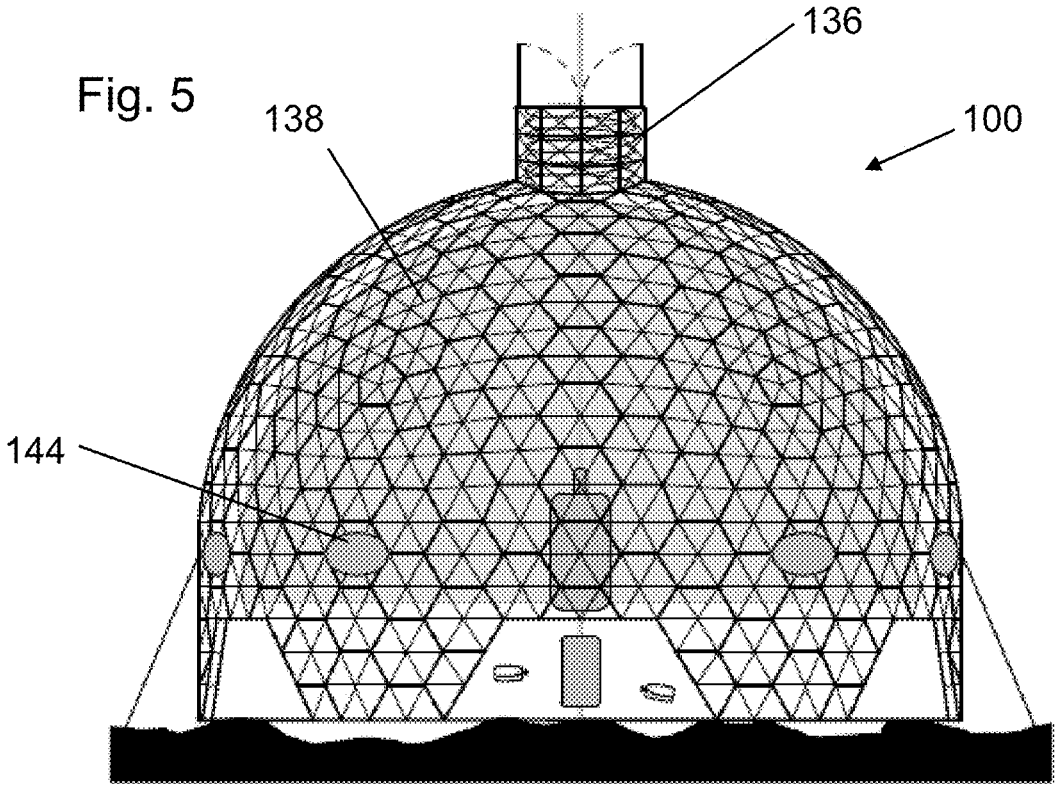
FIG. 5 is an elevation section view of the split emergency containment dome with the inner liner in an elevated configuration.

Thereafter an option with a sleeve 136, which is illustrated in FIG. 5, may have an appendage attached to the top of the dome, and housed within is a retractable coil chute—coil tube mechanism to be released to bring upward to surface of the body of water to thereby cause gas and/or oil that leaks inside of the split emergency containment dome 100 collected oil and/or gas to be delivered to a collection ship.

The split emergency containment dome 100 may include at least one of an outer skin and an inner skin. The outer skin may extend over at least a portion of an outer surface of the outer dome section 120 and the inner skin may extend over at least a portion of the inner surface of the inner dome section 122.

The outer skin and the inner skin may be fabricated as a single piece of material. Alternatively, the outer skin and the inner skin may be fabricated from a plurality of pieces of cover material 124. For example, one of the pieces of cover material 124 may substantially cover each of the openings defined in the outer dome section 120 and the inner dome section 122. While FIGS. 1 and 2 illustrate the pieces of material 124 on the outer dome section 120, a person of skill in the art will appreciate that a similar configuration can be used in conjunction with the inner dome section 122.

The outer skin and inner skin may be fabricated from a variety of materials using the concepts of the invention. The outer skin and inner skin should have sufficient strength to resist deformation and breakage under the conditions at which the split emergency containment dome 100 is utilized. A variety of techniques may be used to attach the outer skin and the inner skin.

The outer skin and the inner skin should resist degradation when exposed to the materials in which the split emergency containment dome 100 is used such as salt and organisms present in ocean water. Examples of two such materials that may be utilized to fabricate the outer skin and the inner skin are metallic, polymeric sheets, or perforated materials.

At least one of the outer skin and the inner skin may be operably attached to the split emergency containment dome 100. Using such a configuration enables at least a portion of the outer skin and the inner skin to pivot or otherwise move with respect to the other portions of the split emergency containment dome 100.

This configuration enables the split emergency containment dome 100 to absorb the energy caused by the water movement and thereby reduce the potential of movement of the split emergency containment dome 100 and/or damage to the split emergency containment dome 100 caused by the water movement.

The split emergency containment dome 100 defines an enclosed region 139 in an interior thereof. In situations where undersea water movement is significant, the split emergency containment dome 100 may be formed without the outer skin and the inner skin. Rather, the split emergency containment dome 100 may include a flexible enclosure 138 that is attached inside the split emergency containment dome 100 intermediate an upper end and a lower end of the split emergency containment dome 100 in which the oil and/or gas is to collect is relatively close to the seabed, as illustrated in FIG. 4. As the oil and/or water collects in the split emergency containment dome 100, the flexible enclosure 138 then expands to an expanded filled bladder configuration within the enclosed region 139, as illustrated in FIG. 5. The flexible enclosure 138 may also provide buoyancy when filled or partially filled with oil and/or gas to assist in raising the split emergency containment dome 100 to the surface after oil recovery is completed.

Such a configuration may be particularly suited for use in areas where the water temperature is relatively warm such that the material used to fabricate the flexible enclosure 138 may be relatively flexible. An example of one material that may be used to fabricate the flexible enclosure 138 is ETFE, or other polymeric material for a flexible bladder for oil/gas containment.

In locations that are particularly sensitive to gas and/or oil that leaks from the oil well, it is possible to fabricate the split emergency containment dome 100 with the flexible enclosure 138 as well as at least one of the outer skin and the inner skin.

As an alternative to or in addition to allowing the collecting oil and/or gas to cause the flexible enclosure 138 to raise, it is possible to use at least one wire that causes the flexible enclosure 138 to raise. Several of the wires may be positioned in a spaced-apart orientation around the split emergency containment dome 100 to thereby cause the flexible enclosure 138 to be raised evenly.

At least one bumper 144 may be mounted on the inner surface of the inner dome section 122. The bumper 144 may prevent the raising flexible enclosure from contacting the inner surface of the inner dome section 122. The bumper 144 thereby resists the potential of the flexible enclosure 138 being damaged by contact with the inner surface of the inner dome section 122. An example of one type of damage is puncturing of the flexible enclosure 138.

Suitable materials that are used to fabricate the bumpers 144 may depend upon factors such as the depth at which the split emergency containment dome 100 is intended to be used and the temperature of the water in the area where the split emergency containment dome 100 is intended to be used. In certain embodiments, the bumpers 144 are fabricated from a resilient material.

In certain embodiments, the wires may be connected to a retraction mechanism (not shown) mounted on the split emergency containment dome 100. In other embodiments, the wire may be connected to a retraction mechanism position at or proximate to an upper surface of the body of water.

In certain embodiments, the split emergency containment dome 100 may include a support shelf 190 that is mounted in a generally horizontal orientation in a spaced-apart orientation from the seabed. The support shelf 190 is illustrated in FIG. 6. An example of one configuration for the support shelf is a plurality of wires that are configured in a relatively planar configuration.

At least a portion of the outer surface of the split emergency containment dome 100 may include structures that limit the ability of underwater animals to enter and/or damage the split emergency containment dome 100. An example of such structures includes mesh and extensions.

Alternatively or additionally, sharp spikes each having a length of between about 12 inches and 18 inches may be attached to dome structural nodes at outer dome to help ward off sea creatures. The spikes may be located at geometry triangle nodes and may be attached by mechanical means.

Proximate a lower edge of the split emergency containment dome 100, a plurality of lower openings 150 may be provided. The lower openings 150 may facilitate moving equipment into and out of the interior of the split emergency containment dome 100. Examples of such equipment include equipment that is used in conjunction with drilling the oil well, removing oil and/or gas from the oil well as well as stopping the leak from the oil well. One type of equipment is a remotely operated vehicle that is used to perform various underwater tasks associated with the oil well.

As illustrated in FIG. 1, the lower openings 150 may be relatively large. The relatively large lower openings 150 do not significantly impact the ability of the split emergency containment dome 100 to contain the oil and/or gas that leaks from the oil well because such leaked oil and/or gas collects in the upper interior portion of the split emergency containment dome 100. The lower openings 150 may also accommodate irregularities in the shape of the surface on which the split emergency containment dome 100 is placed.

The lower openings 150 may be defined by a plurality of support legs 152 that extend from the lower edge of the split emergency containment dome 100. In certain embodiments, the support legs 152 may have a generally triangular shape and may be fabricated from a plurality of structural elements similar to the other portions of the split emergency containment dome 100.

A plurality of mooring lines 160 may be used to retain the split emergency containment dome 100 in a generally stationary position with respect to the oil well. The number of mooring lines 160 that are utilized may depend on factors such as the size of the split emergency containment dome 100 and water currents proximate to where the split emergency containment dome 100 is installed.

The split emergency containment dome 100 may also include a plurality of buoyancy floatation bags that enhance the ability of the split emergency containment dome 100 to resist movement with respect to the oil well. The floatation bags may also be used to lower the split emergency containment dome 100 into position with respect to the oil well.

The floatation bags may include an outer enclosure that is adapted to receive a relatively dense liquid that is capable of causing the split emergency containment dome 100 to sink in the water. Alternatively or additionally, a non-liquid material may be used.

The floatation bags may be releasable attached to the split emergency containment dome 100. Using such a configuration enables the floatation bags to be detached from the split emergency containment dome 100 such as when it is desired to move the split emergency containment dome 100.

The floatation bags may include a plurality of outer floatation bags 161 and a plurality of inner floatation bags 162. The outer floatation bags 161 are attached to an outer surface of the split emergency containment dome 100, as illustrated in FIGS. 1 and 2. The outer floatation bags 161 may be positioned in a spaced-apart orientation around the outer surface of the split emergency containment dome 100.

The inner floatation bags 162 may be positioned between the outer dome section 120 and the inner dome section 122. Alternatively or additionally, the inner floatation bags 162 may be positioned on an inner surface of the inner dome section 122.

A plurality of lines 170 may be attached to the split emergency containment dome 100 to control lowering of the split emergency containment dome 100 into a position over the oil well. The number of lines 170 may be selected based upon factors such as the size of the split emergency containment dome 100 and the movement of water proximate to the oil well.

At least one collection line extends from the split emergency containment dome 100 to a tanker or other vessel. Using such a system, oil and/or gas that has leaked from the oil well is removed from the interior of the split emergency containment dome 100. A person of skill in the art will appreciate that the size and number of the collection lines is selected based upon factors such as the rate at which the oil and/or gas is leaking from the oil well.

The split emergency containment dome 100 may include sensors to detect conditions around where the split emergency containment dome 100 is located. These sensors may detect the water movements and the presence of oil and/or gas inside of the split emergency containment dome 100. In addition to the sensors, cameras may be used to monitor conditions around where the split emergency containment dome 100 is located.

As an alternative to or in addition to mounting the sensors on the split emergency containment dome 100, the sensors may be mounted a distance from the split emergency containment dome 100. Such remote sensors may be used to detect when a wave is moving towards the split emergency containment dome 100.

An option for transporting the split emergency containment dome 100 is to place the split emergency containment dome 100 on the surface of a heavy cargo transport ship. Another option for transporting the split emergency containment dome 100 is to float the split emergency containment dome 100 to site by use of sea transport tug boats.

It may be desirable to increase buoyancy or stabilize the split emergency containment dome 100 with ballast during transportation to the installation site. Increased buoyancy or stabilization with ballast can be accomplished by filling buoyancy/ballast tanks, buoyancy/ballast tank bladders and buoyancy/ballast bridging ring with appropriate amounts of buoyancy/ballast materials.

Once the area where the oil well is located is reached, the split emergency containment dome 100 is lowered through the body of water towards the seabed beneath the body of water. In certain embodiments, a plurality of cables 170 is used to lower the split emergency containment dome 100 to the seabed. The cables 170 may not only be used to guide the descent of the split emergency containment dome 100 but may also be used to assist with the ascent of the split emergency containment dome 100.

In certain embodiments, to enhance the ability to lower the split emergency containment dome 100 through the body of water, the cap section 130 may be detached from the other portions of the split emergency containment dome 100 as the split emergency containment dome 100 is being lowered to the seabed beneath the body of water.

To increase the weight of the split emergency containment dome 100 and thereby stabilize and increase the rate at which the split emergency containment dome 100 can descend through the body of water, a plurality of weights may be attached to the split emergency containment dome 100. The weights may be configured to be released and/or emptied once the split emergency containment dome 100 reaches the ground surface beneath the body of water.

To minimize the potential of a negative environmental impact from such release, materials used to fabricate the weights and/or placed inside of the weights may be indigenous to the region where the split emergency containment dome 100 is being used. An example of one such indigenous material is sand or seawater.

Alternatively, the weights may be left in attachment with the split emergency containment dome 100 to assist in retaining the split emergency containment dome 100 in a stationary position with respect to the oil well.

After installation, the split emergency containment dome 100 will substantially encapsulate the oil and/or gas that leaks from the oil well. Such encapsulation enables the leaked oil and/or gas to be recovered such as by extending a conduit as a feed line into the interior of the split emergency containment dome 100. The split emergency containment dome 100 thereby minimizes the escape of oil and gas, which thereby minimizes the potential of negative environmental impact from the escaped oil.

In certain configurations, it is possible to contain, hold and then withdraw sufficient oil that leaks into the split emergency containment dome 100 so that the oil is substantially contained within the split emergency containment dome 100 until it is possible to stop the oil well from leaking. In other configurations, it may be desirable to employ additional techniques to control the rate at which the oil is leaking and/or prevent the oil from escaping from the split emergency containment dome 100.

Another embodiment of the split emergency containment dome is illustrated at 200 in FIGS. 7-9. The split emergency containment dome 200 may have a generally hexagonal profile. The other aspects of the split emergency containment dome 200 are similar to the corresponding aspects of the split emergency containment dome 100 illustrated in FIGS. 1-6.

Figure 11:
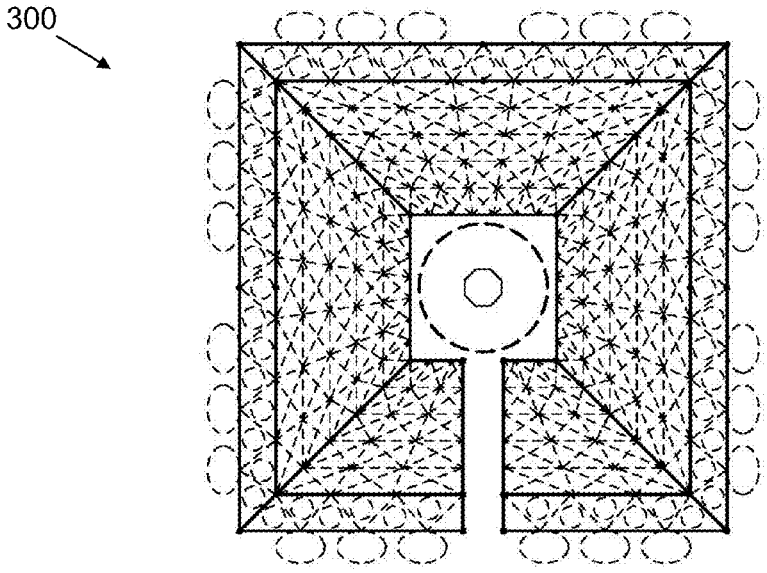
FIG. 11 is a plan view of the split emergency containment dome of FIG. 10.
Figure 12:
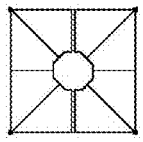
FIG. 12 is a top view of cover panels for use with the split emergency containment dome of FIG. 10.
Figure 10:
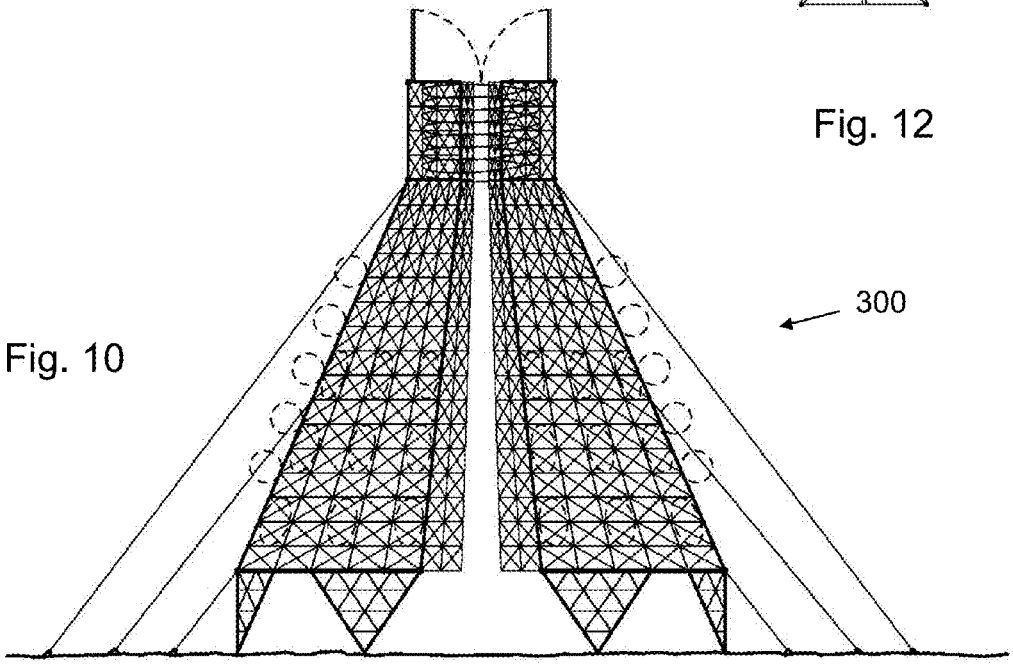
FIG. 10 is an elevation view of a split emergency containment dome according to an embodiment of the invention.

Another embodiment of the split emergency containment dome is illustrated at 300 in FIGS. 10-12. The split emergency containment dome 300 may have a generally square profile. The other aspects of the split emergency containment dome 300 are similar to the corresponding aspects of the split emergency containment dome 100 illustrated in FIGS. 1-6.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A split emergency containment dome for use in conjunction with an underwater oil or gas well, wherein the split emergency containment dome comprises:

an upper containment portion having an enclosed region defined therein that is adapted to receive equipment used in conjunction with the underwater well and to retain therein oil or gas that escapes from the underwater well, wherein the upper containment portion is fabricated from a plurality of structural beams that form a wall having an opening formed therein, wherein the opening extends from a lower end to an upper end of the upper containment portion, wherein the upper containment portion comprises an inner dome section and an outer dome section and wherein the inner dome section is attached to the outer dome section and wherein at least a portion of the upper containment portion has a geodesic shape;

a cover material that extends over at least a portion of the upper containment portion, wherein the cover material is substantially impermeable to at least one of oil and gas;

a closure mechanism that is capable of selectively closing at least a portion of the opening; and at least one conduit attached to the upper containment portion for removing oil or gas from the enclosed region.

2. The split emergency containment dome of claim 1, wherein the closure mechanism is movable between an open configuration and a closed configuration.

3. The split emergency containment dome of claim 1, and further comprising a lock mechanism that is capable of maintaining the closure mechanism in a closed configuration.

4. The split emergency containment dome of claim 1, and further comprising a lower containment portion that is attached to the lower end of the upper containment portion, wherein at least a portion of the lower containment portion has a cylindrical shape.

5. The split emergency containment dome of claim 1, and further comprising:

a top opening formed in the upper containment portion; and a cap section that is attachable to the upper containment portion to substantially close the top opening, wherein the cap section is movable between an open configuration and a closed configuration.

6. The split emergency containment dome of claim 1, and further comprising a buoyancy or ballast material that is placed in the at least one bladder, wherein the buoyancy or ballast material has a density that is not less than a density of water or is less than the density of water.

7. A method of containing and recovering oil or gas that leaks from an underwater well that is located beneath a surface of a body of water, wherein the method comprises:

constructing a split emergency containment dome comprising an upper containment portion, a cover material and at least one conduit, wherein the upper containment portion is fabricated from a plurality of structural beams and has enclosed region defined therein that is adapted to receive equipment used in conjunction with underwater well and to retain therein oil or gas that escapes from the underwater well, wherein the upper containment portion comprises a wall having an opening formed therein and wherein the opening extends from a lower end to an upper end of the upper containment portion, wherein the upper containment portion comprises an inner dome section and an outer dome section, wherein the inner dome section is attached to the outer dome section and wherein at least a portion of the upper containment portion has a geodesic shape, wherein the cover material extends over at least a portion of the upper containment portion, wherein the cover material is substantially impermeable to at least one of oil and gas and wherein the at least one conduit is attached to the upper containment portion for removing oil or gas from the enclosed region;

moving the split emergency containment dome into a position that is over the underwater well, wherein as the split emergency containment dome is moved into the position over the underwater well, the at least one conduit passes through the opening; and at least partially closing the opening with a closure mechanism that is operably attached to the split emergency containment dome.

8. The containment and recovery method of claim 7, and further comprising:

discharging oil or gas from the underwater well into the water;

substantially containing the oil or gas within the split emergency containment dome; and transferring the oil or gas from the split emergency containment dome to a collection vessel.

9. The containment and recovery method of claim 7, and further comprising retaining the closure mechanism in a closed configuration with respect to the split emergency containment dome using a lock mechanism.

10. The containment and recovery method of claim 7, and further comprising conveying the oil or gas from the split emergency containment dome to a collection apparatus.

* * * * *